US006715481B1

(12) United States Patent
Anderson

(10) Patent No.: US 6,715,481 B1
(45) Date of Patent: Apr. 6, 2004

(54) ARCHERY BOW WITH ZERO BRACE HEIGHT

(76) Inventor: Jeffrey R. Anderson, P.O. Box 566, Wauconda, IL (US) 60084

( * ) Notice: Subject to any disclaimer, the term of this patent is extended or adjusted under 35 U.S.C. 154(b) by 67 days.

(21) Appl. No.: 10/307,065

(22) Filed: Nov. 29, 2002

(51) Int. Cl.[7] ..... F41B 5/22; F41B 5/16
(52) U.S. Cl. ..... 124/88; 124/90; 124/23.1
(58) Field of Search ..... 124/86, 88, 89, 124/90, 23.1, 25.6

(56) References Cited

U.S. PATENT DOCUMENTS

| | | | | | |
|---|---|---|---|---|---|
| 3,834,368 | A | * | 9/1974 | Geiger | 124/20.3 |
| 4,457,287 | A | * | 7/1984 | Babington | 124/23.1 |
| 4,829,974 | A | | 5/1989 | Anderson | 124/24 R |
| 4,957,093 | A | | 9/1990 | Hamlett | 124/24.1 |
| 4,958,617 | A | | 9/1990 | Anderson | 124/24.1 |
| 5,119,796 | A | * | 6/1992 | Dehlbom | 124/23.1 |
| 5,119,797 | A | | 6/1992 | Anderson | 124/25 |
| 5,205,268 | A | * | 4/1993 | Savage | 124/24.1 |
| 5,263,465 | A | | 11/1993 | Anderson | 124/24.1 |
| 5,349,937 | A | * | 9/1994 | Burling | 124/25.6 |
| 5,853,001 | A | * | 12/1998 | Vyprachticky | 124/88 |
| 6,142,133 | A | | 11/2000 | Anderson | 124/25.6 |

* cited by examiner

*Primary Examiner*—Kien T. Nguyen

(57) ABSTRACT

A novel handheld compound archery bow (100) includes a riser (102) with a keyhole (410), an arrow rest assembly (150) extending through the keyhole (410), a bowstring (130), and a side grip assembly (180) with a side grip (201) and an arm brace (116). The side grip (201) is attached to a side grip base (112) and extends in a substantially perpendicular direction from the plane of the novel bow (100), formed by the center line of the arrow rest assembly (150) and the bowstring (130). The valley (202) of the side grip (201) is substantially opposite to the bowstring (130) to provide a zero brace height. Since the brace height is substantially zero, the power stroke of the novel bow (100) is the entire full-draw length. As a result, an embodiment of the novel bow (100) with axle to axle length of 37 inches is capable of AMO and IBO arrow speeds of 264 and 333 feet per second, respectively.

19 Claims, 5 Drawing Sheets

ARCHERY BOW WITH ZERO BRACE HEIGHT

FIELD OF THE INVENTION

The present invention relates generally to the field of archery bows, and more particularly to a handheld archery bow with a substantially zero brace height.

BACKGROUND OF THE INVENTION

A conventional handheld compound archery bow includes a riser coupled to top and bottom limbs and further includes top and bottom cams that each has an axle coupling it to the end of the respective limb. In order that an archer can hold the bow, a grip is located on the riser substantially at the midpoint between the axle of the top cam and the axle of the bottom cam. An arrow rest is typically located on the riser just above the top of the grip. To allow space for the archer's hand and the fletching of an arrow and to facilitate reliable and accurate operation, the bowstring at rest is spaced from four to ten inches away from the valley of the grip located on its rear surface. This spacing between the bowstring at rest and the valley of the grip is referred to as the brace height of the archery bow. The power stroke of the archery bow is the difference between the draw length and the brace height. The longer the power stroke, the faster an arrow is released. The brace height has effectively imposed an insurmountable barrier to achieving a longer power stroke in prior art handheld compound archery bows. Accordingly, there is a need for an improved handheld compound archery bow with a substantially zero brace height, thereby maximizing the length of the power stroke and increasing the speed at which an arrow is launched.

DETAILED DESCRIPTION OF THE PREFERRED EMBODIMENTS

An archery bow has first and second limbs, a riser to receive the first end of the first and second limbs, first and second cams each with an axle each attached to the end of a respective limb, a bowstring extending between the first and second cams, a string release, an arrow rest assembly comprised of an elongated track coupled to the riser and having a muzzle end and a breach end coupled to the string release, the arrow rest assembly having a center line disposed substantially midway between the axle of the first cam and the axle of the second cam, and a side grip assembly coupled to the riser and having a side grip and an arm brace, the side grip extending outwardly from a plane formed by the bowstring and the center line of the arrow rest assembly, the side grip and bowstring disposed substantially opposite to one another.

Figure 1:
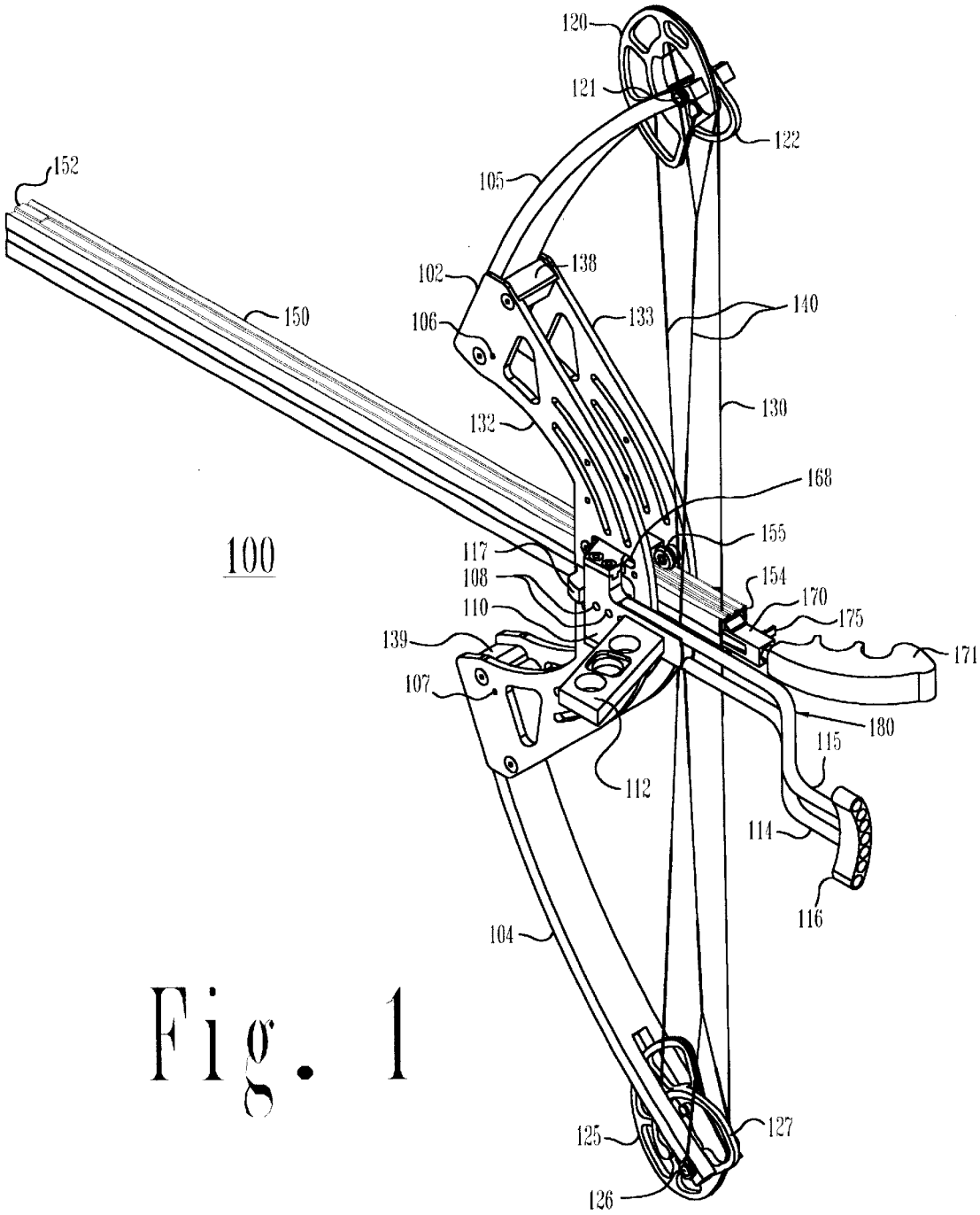
FIG. 1 is a left-side perspective view of the handheld compound archery bow embodying my invention.

Referring now to FIG. 1, there is illustrated a left-side perspective view of a preferred embodiment of the handheld compound archery bow 100 embodying my invention. Bow 100 includes a riser 102, first and second limbs 104 and 105, top cam 120, bottom cam 125, bowstring 130, harness 140, and arrow rest assembly 150. A grip support 110 is attached to side grip base 112, arm brace rods 114 & 115, and arm brace 116, forming a side grip assembly 180 that is coupled by grip riser arms 118 & 119 (see FIG. 3) to the riser 102 and pivots outwardly from, or in a direction substantially perpendicular to, the plane of bow 100 (formed by the center line of the arrow rest assembly 150 and the bowstring 130). The outward pivoting rotation of grip support 110 is limited by grip stop 117. A side grip 201 typically comprised of a one or more pieces of wood or hard rubber attaches to side grip base 112, as illustrated in FIG. 4.

The arrow rest assembly 150 is an elongated track having a muzzle end 152 and a breach end 154. The muzzle end 152 of the arrow rest assembly 150 extends through a keyhole 410 (see FIG. 3) in the riser 102 and is supported on rollers 155, 156, 157 and 158 mounted to riser 102. The arrow rest assembly 150 is disposed at the horizontal center line of bow 100 substantially half way between axles 121 & 126 of top and bottom cams 120 & 125 and substantially perpendicular to the bowstring 130. A dual-caliper string release 170 with trigger 175 and string release grip 171 (both commercially available components) are attached to the breach end 154 of the arrow rest assembly 150.

According to a novel feature of my invention, riser 102 includes left side 132 and right side 133 attached to limb pocket 138 at one end and limb pocket 139 at the other end. Limb pocket 138 accepts limb 105, and limb pocket 139 accepts limb 104. Limb pin oil holes 106 & 107 are provided for the purpose of facilitating the oiling of limb pockets 138 & 139. Keyhole 410 is formed in riser 102 by riser supports 412 & 413, as illustrated in more detail in FIG. 3. The arrow rest assembly 150 extends through the keyhole 410 in riser 102.

Figure 2:
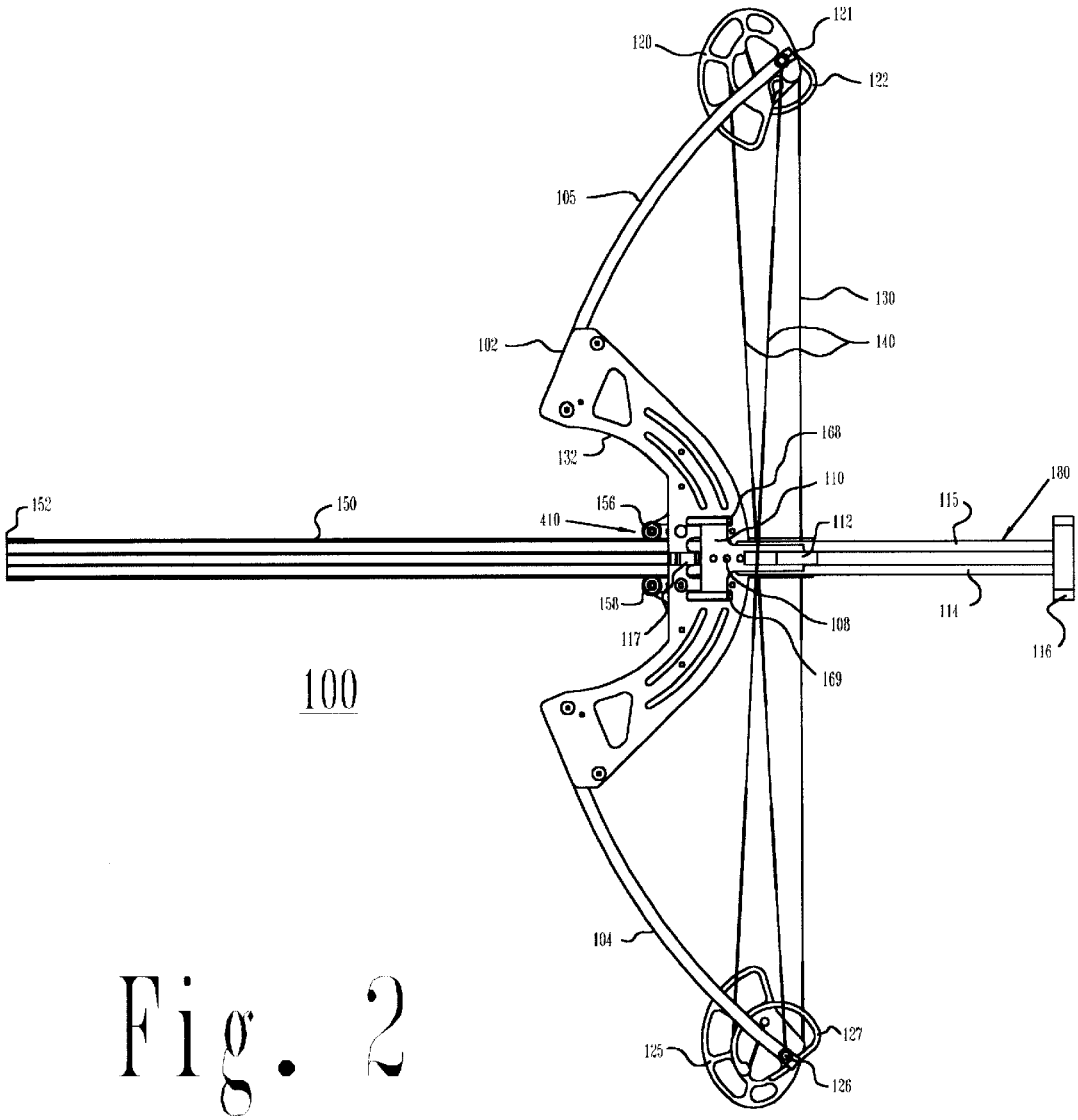
FIG. 2 is a left side view of the handheld compound archery bow in FIG. 1.
Figure 4:
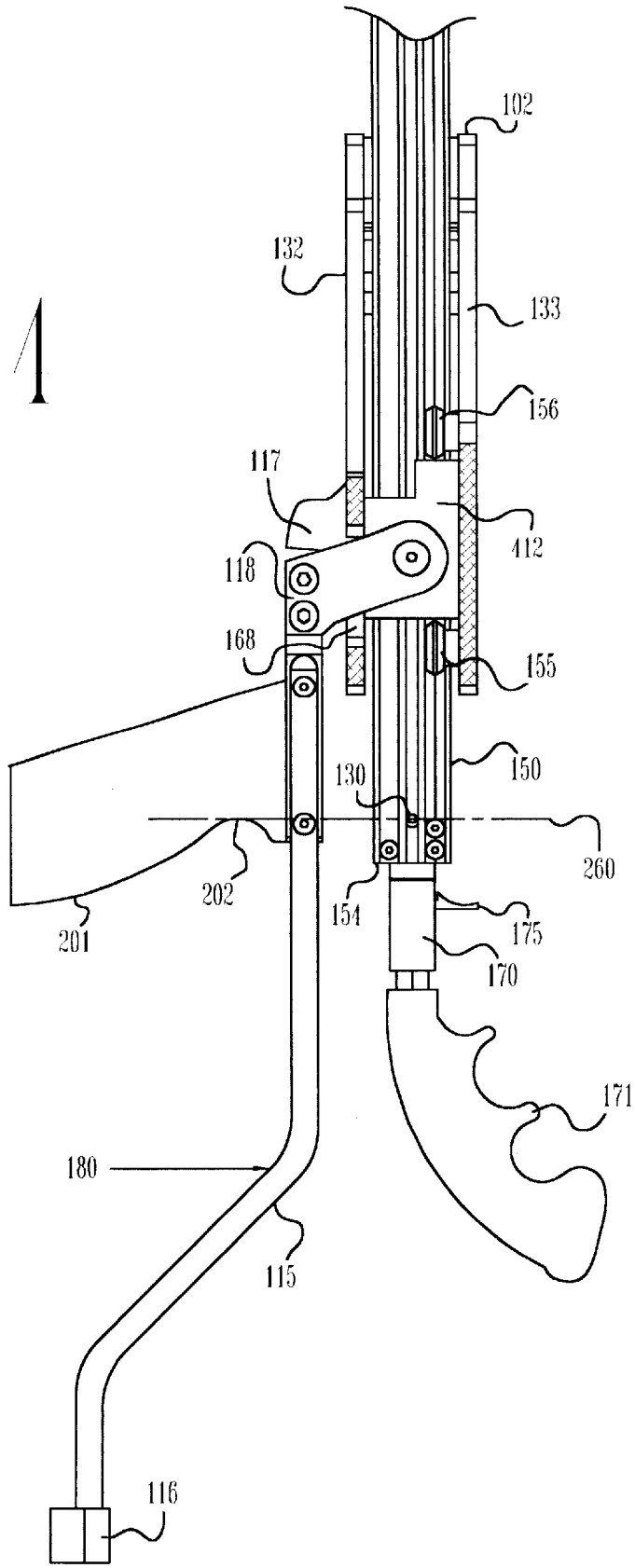
FIG. 4 a top view of the handheld compound archery bow in FIG. 1, looking from the top toward the arrow rest assembly.

According to another novel feature of my invention, the riser 102 is shaped such that side grip 201 in FIG. 4 is disposed opposite to bowstring 130 to provide a substantially zero brace height. In FIG. 1, the left and right sides 132 & 133 of riser 102 are curved or extend in toward the bowstring (e.g., concave in shape). The brace height of bow 100 is the distance between the bowstring 130 and the valley 202 of the side grip 201 located on its rear surface. Thus, the valley 202 of the side grip 201 or the rear surface of side grip 201 is disposed substantially opposite to the bowstring 130, as shown by line 260 in FIG. 4. The brace height may be adjusted using grip holes 108 (three grip holes are shown in FIGS. 1 and 2) to be slightly negative or positive. For example, holes 108 may be used to allow the brace height to be adjusted to one of substantially zero, a predetermined positive amount (e.g. to plus one inch in several steps) and a predetermined negative amount (e.g., to minus one inch in several steps). The power stroke of a bow is the difference between the brace height and the full-draw length. Since the brace height of a conventional compound bow is between 4 and 10 inches, the power stroke of conventional bows is reduced by such 4 to 10 inches so that the speed at which an arrow can be launched is accordingly reduced. In the compound bow 100 embodying my invention, the brace height is substantially zero such that the power stroke of bow 100 is substantially the same as the full-draw length, thereby greatly increasing the speed at which an arrow is launched. An embodiment of bow 100 with an axle to axle length of 37 inches and zero brace height has exhibited an AMO speed of 264 feet per second. AMO speed is measured with a 60 pound draw weight, 30 inch draw length and 540 grain arrow. This embodiment of bow 100 also has exhibited an IBO speed of 333 feet per second. IBO speed is measured with a 70 pound draw weight, 30 inch draw length and 350 grain arrow. The AMO and IBO speeds of such embodiment of bow 100 exceed by a good amount the corresponding speeds of currently-available conventional handheld compound archery bows.

Referring now to FIG. 2, there is illustrated a left side view of the handheld compound archery bow 100 in FIG. 1. Elements in FIG. 2 that are identical to elements in FIG. 1 are labeled with the same reference number. In the preferred embodiment, the cams 120 and 125 are so called "hatchet cams". Any suitable type of cam (e.g. circular, elliptical, etc.) may be used in bow 100. The top cam 120 has an axle 121 attached to limb 105 about which it rotates when bow 100 is drawn, and the bottom cam 125 has an axle 126 attached to limb 104 about which it rotates when bow 100 is drawn. The bowstring 130 has a first end which is wound around top cam 120 and attached to a post thereof. Similarly, the bowstring 130 has a second end which is wound around bottom cam 125 and attached to a post thereof. The top cam 120 is attached to a module 122, and the bottom cam 125 is attached to a module 127. The modules 122 and 127 are attached to the harness 140, a first end of the harness 140 attached to a post of module 122 and a second end of the harness 140 attached to a post of module 127. The modules 122 and 127 are preferably geometrically identical in size and shape, and are positioned in exactly the same relationship to their respective axles 121 and 126. When bow 100 is drawn, the modules 122 and 127 and harness 140 turn in synchronism with one another, each rotating the same number of degrees. The modules 122 and 127 in turn synchronously rotate the cams 120 and 125, respectively, when the bow 100 is drawn.

The horizontal center line of bow 100 extends perpendicular from a point midway between the axle 121 and axle 126 through the center of keyhole 410 in riser 102. The center line of the arrow rest assembly 150 is substantially collinear with the horizontal center line of bow 100. The plane of the bow 100 is formed by the bowstring 130 and the center line of the arrow rest assembly 150. In the embodiment in FIGS. 1–4, the bow 100 has an axle to axle length of approximately 37 inches. The side grip 201 attached to side grip base 112 is located on the riser 102 substantially at the horizontal center line of bow 100 so that it can be drawn more easily.

The center line of an arrow inserted into the muzzle end 152 of the arrow rest assembly 150 is substantially collinear with the center line of the arrow rest assembly 150 and the horizontal center line of bow 100. The nock end of an arrow rests against the bowstring at a nock point on the bowstring 130 at the breach end 154 of the arrow rest assembly 150. The nock point on the bowstring 130 is positioned to allow an arrow to be substantially perpendicular to the bowstring in the at-rest position. According to a feature of my invention, the nock point on the bowstring 130 travels in a straight line collinear with the horizontal center line of bow 100, when the bowstring 130 is pulled back and when the bowstring 130 is released. Since the nock point travels in a straight line, the energy of the drawn bowstring is focused substantially solely on imparting linear column load to the arrow. As a result, the handheld compound archery bow 100 embodying my invention is easier to draw, operates quieter, and is more accurate and faster.

Figure 3:
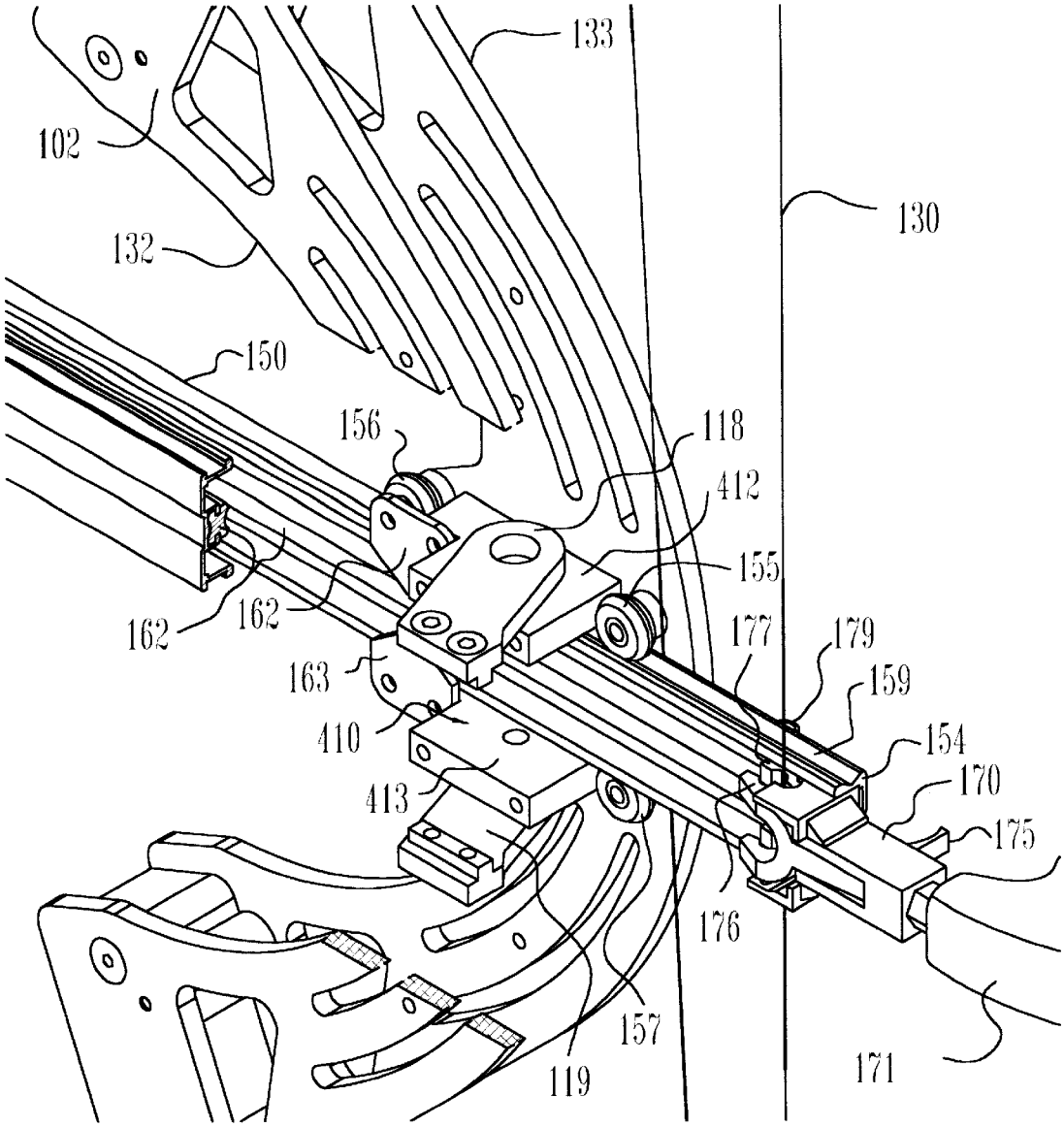
FIG. 3 is close up perspective view of the riser of the handheld compound archery bow in FIG. 1, where the left side of the riser has been partially cut away.

Referring now to FIG. 3, is close up perspective view of the riser 102 of the handheld compound archery bow 100 in FIG. 1, where the left side 132 of the riser 102 has been partially cut away. Elements in FIG. 3 that are identical to elements in FIG. 1 are labeled with the same reference number. Grip riser arms 118 & 119 are rotatably coupled to riser supports 412 & 413, respectively, so that grip support 110 and side grip base 112 of side grip assembly 180 pivot outwardly from, or in a direction substantially perpendicular to, the plane of the bow 100. Grip riser arms 118 & 119 and grip support 110 include tongue-in-groove construction for additional strength. Grip riser arms 118 & 119 of side grip assembly 180 extend through slots 168 & 169 (see FIG. 2) in the left side 132 of riser 102 and are hinged in the center of the riser 102, as shown in more detail in FIG. 4. Riser supports 412 & 413 are attached to left and right sides 132 & 133 of riser 102 to form keyhole 410. Arrow rest assembly 150 extends through the keyhole 410 in riser 102. Arrow rest assembly 150 includes a V-groove track 159 that engages V-shaped rollers 155 & 156 and a V-groove track (not shown, but opposite to V-groove track 159) that engages V-shaped rollers 157 & 158. Arrow spring 179 applies a force to an arrow in the arrow rest assembly 150 to keep the nock of the arrow against the bowstring 130. Track stops 162 & 163 engage breach end 152 preventing the arrow rest assembly 150 from being pulled completely out of keyhole 410. Track stops 162 & 163 also urge an arrow back into the center of the arrow rest assembly 150, as bow 100 is drawn. Dual calipers 176 & 177 of the release 170 are exposed by the cut away of the left side track of arrow rest assembly 150.

Referring now to FIG. 4, there is illustrated a top view of the handheld compound archery bow 100 in FIG. 1, looking from the top toward the arrow rest assembly 150 where the top portion of the left side 132 and the top portion of the right side 133 of riser 102 have been cut away. Elements in FIG. 4 that are identical to elements in FIG. 1 are labeled with the same reference number. Side grip 201 extends in a substantially perpendicular direction from the plane of the bow 100, formed by the center line of the arrow rest assembly 150 and the bowstring 130. The valley 202 of side grip 201 is substantially opposite to bowstring 130 to provide a zero brace height, as illustrated by line 260. Line 260 extends though the middle of bowstring 130 in a direction that is perpendicular to the plane of bow 100. If side grip 201 is moved slightly to the right, bow 100 will have a slightly negative brace height. Conversely, if side grip 201 is moved slightly to the left, bow 100 will have a slightly positive brace height. By utilizing my invention, bow 100 has a substantially zero brace height such that the power stroke of bow 100 is substantially the same as the full-draw length.

Figure 5:
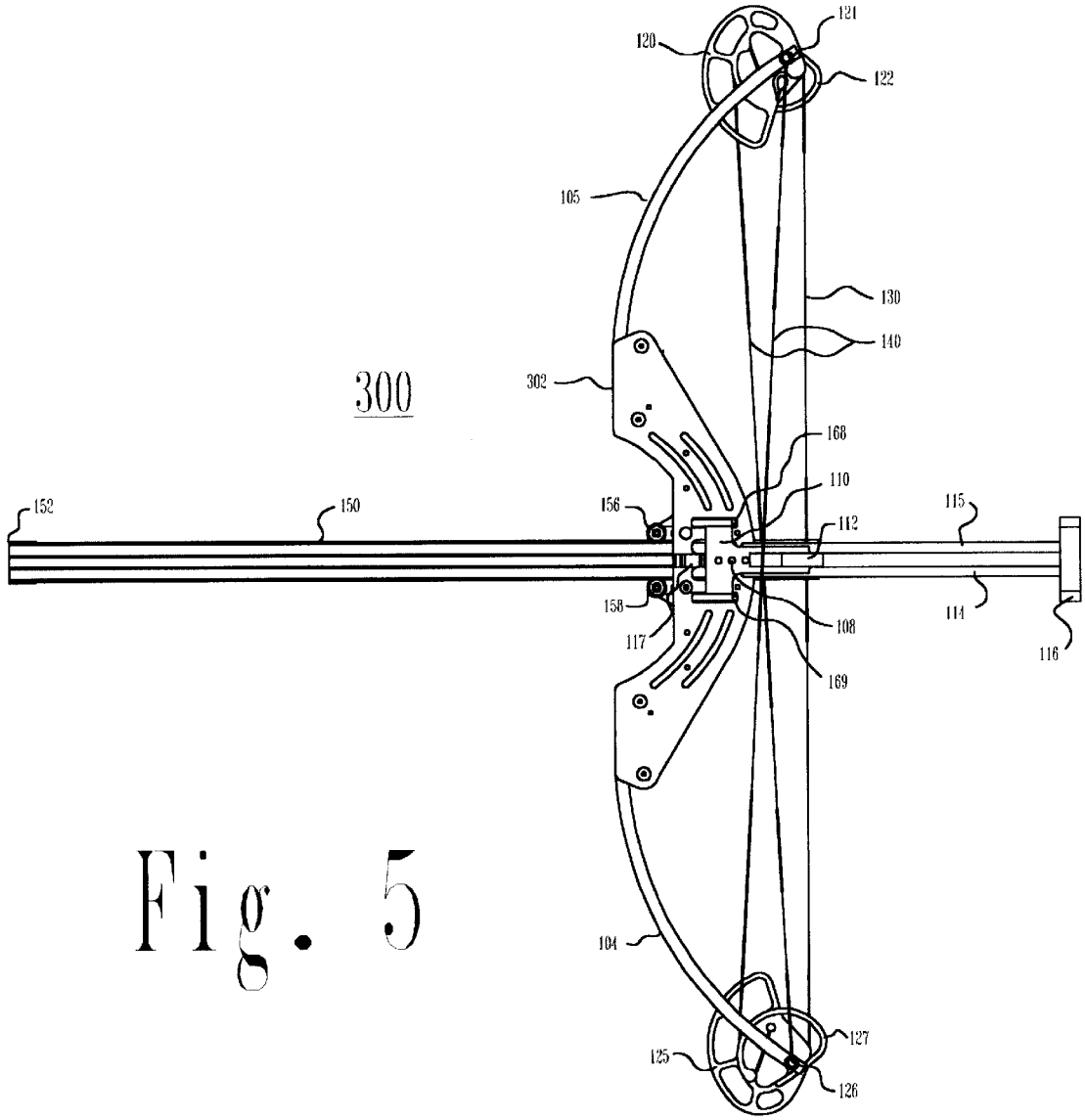
FIG. 5 a left-side view of an alternate embodiment of a handheld compound archery bow embodying my invention.

Referring now to FIG. 5, there is illustrated a left-side view of an alternate embodiment of a handheld compound archery bow 300 embodying my invention. Elements in FIG. 5 that are identical to elements in FIG. 1 are labeled with the same reference number. Bow 300 includes a riser 302 that is less curved than riser 102 in FIG. 1, while still maintaining side grip base 112 substantially opposite to bowstring 130 to provide a zero brace height. Riser 302 could also be "T"-shaped, where the limbs 104 & 105 couple to the top of the "T" and the center of the "T" extends toward the bowstring 130 to support and position side grip base 112 substantially opposite to bowstring 130. Thus, riser 302 may have a variety of shapes and structures to provide a zero brace height in accordance with the teachings of my invention.

Compound archery bow 100 in FIG. 1 may be operated as shown and described in my U.S. Pat. Nos. 4,829,974, 4,958,617, 5,263,465 and 6,142, 133, incorporated herein in their entirely by reference thereto. Bow 100 can shoot arrows of any suitable length, including, for example, the short arrow shown in FIG. 3 of my aforementioned U.S. Pat. No. 4,829,974, the short arrow shown and described in my aforementioned U.S. Pat. No. 4,958,617, the short arrow shown in FIG. 5 of my aforementioned U.S. Pat. No. 5,119,797, and the short arrow shown in FIG. 3 of my aforementioned U.S. Pat. No. 5,263,465.

In order to load and shoot an arrow from the compound archery bow 100 in FIG. 1, the arrow rest assembly 150 is pushed forward until the string release 170 touches the bowstring 130. The trigger on string release 170 is pushed forward so that the dual calipers 176 & 177 of the release 170 capture the bowstring 130. Next, the arrow rest assembly 150 is pointed upward and an arrow is inserted into the muzzle end 152 thereof. Two polyurethane (or other suitable material) arrow guide strips 151 (see also strips 36 and 36 in FIG. 6 of the aforementioned U.S. Pat. No. 5,263,465) insert into the arrow rest assembly 150 from the muzzle end. The arrow guide strips guide an arrow that is inserted into the muzzle end 152 of the arrow rest assembly 150. An arrow spring 173 on the side of the arrow rest assembly 150 at the breach end is lifted to allow the nock end of the arrow to come into contact with the bowstring 130. The arrow spring 179 (see also spring 173 in FIG. 1 of the aforementioned U.S. Pat. No. 6,142,133) applies a force to the arrow in the arrow rest assembly 150 so that the arrow does not inadvertently fall out if bow 100 is point downward. Then, in order to shoot, the left hand grasps side grip 201, arm rest 116 engages the side of the left arm, and the bow 100 is drawn in the normal manner by the right hand pulling on the string release grip 171. Bow 100 may also be shot with the right hand grasping side grip 201 and the left hand grasping string release grip 171. The arrow rest assembly 150 reciprocates back on quiet rollers to the fully-drawn position and is held by hand at full draw. Next, the trigger 175 on string release 170 is pulled back to release the arrow. During the release, the hand holding the string release grip 171 is firmly anchored against the cheek. The bow 100 is held steady by one hand on the side grip 201 and the other hand on the string release grip 171. After releasing the bowstring and arrow, the arrow rest assembly 150 is pushed forward so that the dual calipers of the release 170 capture the bowstring 130 in preparation for another shot.

Thus, handheld compound archery bows 100 & 300 embodying my invention include a riser 102 & 302 formed such that a side grip 201 attached to side grip base 112 is disposed opposite to bowstring 130 to provide a substantially zero brace height and a power stroke substantially the same as the full-draw length. The insurmountable barrier of brace heights of 4 to 10 inches faced by prior art handheld compound archery bows has been broken down and done away with by the teachings of my invention, enabling the achievement of much faster AMO and IBO speeds than heretofore attainable.

While particular embodiments of my invention have been shown and described, modifications may be made. It is therefore intended in the appended claims to cover all such changes and modifications which fall within the true spirit and scope of my invention.

What is claimed is:

1. A handheld archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam;

a string release;

an arrow rest assembly comprised of an elongated track coupled to the riser and having a muzzle end and a breach end coupled to the string release, the arrow rest assembly having a center line disposed substantially midway between the axle of the first cam and the axle of the second cam; and a side grip assembly coupled to the riser and having a grip and an arm brace, the grip extending outwardly from a plane formed by the bowstring and the center line of the arrow rest assembly, and the grip and the bowstring disposed substantially opposite to one another.

2. The handheld archery bow according to claim 1, wherein the riser extends in toward the bowstring.

3. The handheld archery bow according to claim 1, wherein the riser curves in toward the bowstring.

4. The handheld archery bow according to claim 1, wherein the riser is concave so as to extend in toward the bowstring.

5. The handheld archery bow according to claim 1, wherein the riser is substantially "T"-shaped where the first and second limbs couple to the top of the "T" and the center of the "T" extends toward the bowstring.

6. The handheld archery bow according to claim 1, wherein the side grip assembly is rotatably coupled to the riser.

7. The handheld archery bow according to claim 1, wherein the side grip assembly is rotatably coupled to the riser by first and second grip riser arms that are hinged in the center of the riser.

8. A handheld archery bow, comprising:

first and second limbs, each having first and second ends;

a riser to receive the first end of the first and second limbs, the riser further having a keyhole;

a first cam with an axle to couple to the second end of the first limb;

a second cam with an axle to couple to the second end of the second limb;

a bowstring extending between the first and second cams;

a string release;

an arrow rest assembly comprised of an elongated track coupled to the riser and having a muzzle end extending through the keyhole and a breach end coupled to the string release, the arrow rest assembly having a center line disposed substantially midway between the axle of the first cam and the axle of the second cam; and a side grip assembly coupled to the riser and having a grip and an arm brace, the grip extending outwardly from a plane formed by the bowstring and the center line of the arrow rest assembly, and the grip further being disposed opposite to the bowstring to provide a substantially zero brace height.

9. The handheld archery bow according to claim 8, wherein the riser extends in toward the bowstring.

10. The handheld archery bow according to claim 8, wherein the side grip assembly is rotatably coupled to the riser.

11. An handheld archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first and second cams;

a string release;

an arrow rest assembly comprised of an elongated track coupled to the riser and having a muzzle end and a breach end coupled to the string release, the arrow rest assembly having a center line disposed substantially midway between the axle of the first cam and the axle of the second cam; and a side grip assembly coupled to the riser and having a grip and an arm brace, the grip extending outwardly from a plane formed by the bowstring and the center line of the arrow rest assembly, and the grip further being disposed at predetermined places with respect to the bowstring to provide a brace height that is one of substantially zero, a predetermined positive amount and a predetermined negative amount.

12. The handheld archery bow according to claim 11, wherein the riser extends in toward the bowstring.

13. The handheld archery bow according to claim 11, wherein the side grip assembly is rotatably coupled to the riser.

14. An handheld archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first and second cams;

a string release;

an arrow rest assembly comprised of an elongated track coupled to the riser and having a muzzle end and a breach end coupled to the string release, the arrow rest assembly having a center line disposed substantially midway between the axle of the first cam and the axle of the second cam; and a side grip assembly coupled to the riser and having a grip and an arm brace, the grip extending outwardly from a plane formed by the bowstring and the center line of the arrow rest assembly, the grip further having a rear surface, and the rear surface of the grip and the bowstring disposed substantially opposite to one another.

15. The handheld archery bow according to claim 14, wherein the riser extends in toward the bowstring.

16. The handheld archery bow according to claim 14, wherein the side grip assembly is rotatably coupled to the riser.

17. A handheld archery bow, comprising:

first and second limbs, each having first and second ends;

a riser having first and second sides, first and second limb pockets, and a keyhole, the first and second sides each having a first end coupled to the first limb pocket and having a second end coupled to the second limb pocket, and the first and second pockets receiving the first end of the first and second limbs, respectively;

a first cam with an axle to couple to the second end of the first limb;

a second cam with an axle to couple to the second end of the second limb;

a bowstring extending between the first and second cams;

a string release;

an arrow rest assembly comprised of an elongated track coupled to the riser and having a muzzle end and a breach end coupled to the string release, the arrow rest assembly having a center line disposed substantially midway between the axle of the first cam and the axle of the second cam; and a side grip assembly coupled to the riser and having a grip and an arm brace, the grip extending outwardly from a plane formed by the bowstring and the center line of the arrow rest assembly, and the grip and the bowstring disposed substantially opposite to one another.

18. The handheld archery bow according to claim 17, wherein the riser extends in toward the bowstring.

19. The handheld archery bow according to claim 17, wherein the side grip assembly is rotatably coupled to the riser.

* * * * *